United States Patent [19]

Prebensen

[11] 4,158,520

[45] Jun. 19, 1979

[54] ROCK BOLTING APPARATUS

[75] Inventor: Sören P. Prebensen, Nacka, Sweden

[73] Assignee: Atlas Copco Aktiebolag, Nacka, Sweden

[21] Appl. No.: 882,236

[22] Filed: Feb. 28, 1978

[30] Foreign Application Priority Data

Mar. 3, 1977 [SE] Sweden ..... 7702348

[51] Int. Cl.[2] ..... E21D 11/00

[52] U.S. Cl. ..... 405/260; 173/29; 173/52; 173/43; 173/31; 173/147

[58] Field of Search ..... 61/45 B; 144/103; 173/29, 31, 43, 52, 46, 147; 408/236; 308/3 A

[56] References Cited

U.S. PATENT DOCUMENTS

| | | | |
|---|---|---|---|
| 2,306,040 | 12/1942 | Curtis | 173/147 X |
| 3,141,511 | 7/1964 | O'Leary | 173/52 X |
| 3,218,893 | 11/1965 | Madison et al. | 173/43 X |
| 3,246,705 | 4/1966 | Chappuis | 173/29 X |
| 3,576,218 | 4/1971 | Lisenby | 173/46 X |

*Primary Examiner*—Lawrence J. Staab
*Attorney, Agent, or Firm*—Flynn & Frishauf

[57] ABSTRACT

A rock bolting apparatus is shown in which a rock drill and a rock bolt setting device are interchangeable on the same elongated guide of a feed beam. When the rock drill is in operative position on the feed beam, the bolt setting device hangs on the side of the feed beam and vice versa.

19 Claims, 11 Drawing Figures

ROCK BOLTING APPARATUS

REFERENCE TO PATENTS PERTINENT TO THE INVENTION

U.S. Pat. Nos. 3,218,893 and 3,246,705.

This invention relates to a rock bolting apparatus that comprises a rock drill and a rock bolt setting device. Some prior art rock bolting apparatuses of this kind comprise a feed beam construction that principally comprises two conventional feed beams that are built together. One of these feed beams has an elongated guide for the rock drill and the other feed beam has an elongated guide for the bolt setting device. The feed beams are turnable in common about an axis parallel with themselves so that, after the drilling of a hole, the bolt setting device can be turned into alignment with the hole that has just been bored. Such an apparatus is heavy and cumbersome.

It is an object of the invention to provide a rock bolting apparatus that is light in weight and reliable. According to the invention there is provided a rock bolting apparatus that comprises a feed beam on which a rock drill and a bolt setting device are mounted, wherein the feed beam has elongated guide means and a feeding device which are common to the rock drill and the bolt setting device, and at least one of the rock drill and the bolt setting device is mounted on the feed beam to be alternatively movable into and out of a working position on the guide means by power means.

DETAILED DESCRIPTION OF PREFERRED EMBODIMENT

Figure 1:
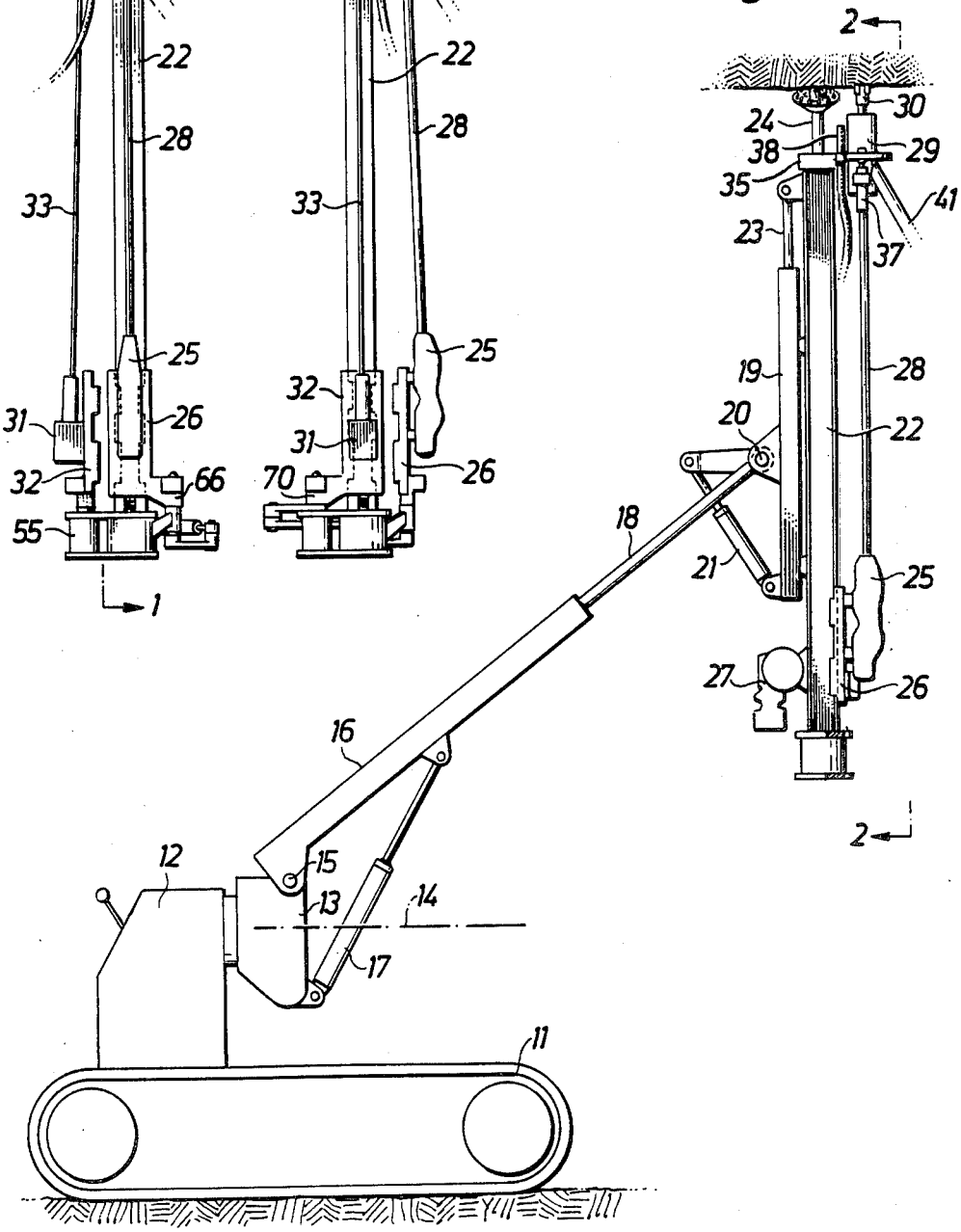
FIG. 1 is a side view of a rock bolting apparatus mounted on the outer end of a boom that is carried by a crawler borne chassis, the figure being taken along line 1—1 in FIG. 2.

In FIG. 1, a crawler wagon 11 is shown which has an upright frame portion 12 on which a holder 13 is turnably mounted to be turned about a horizontal axis 14 by means of a non-illustrated motor. The holder 13 carries by means of a pivot 15 the inner end of a boom 16 that is swingable by means of the hydraulic cylinder 17. The boom 16 is telescopically extensible and its outer portion 18 carries a feed beam holder 19 that can be swung about a horizontal axis 20 by means of a hydraulic cylinder 21. The feed beam holder 19 carries a feed beam 22 which is axially displaceable relative to the holder 19 by means of a hydraulic cylinder that is located inside the holder 19 and has a piston rod that has been designed by 23.

Figure 2:
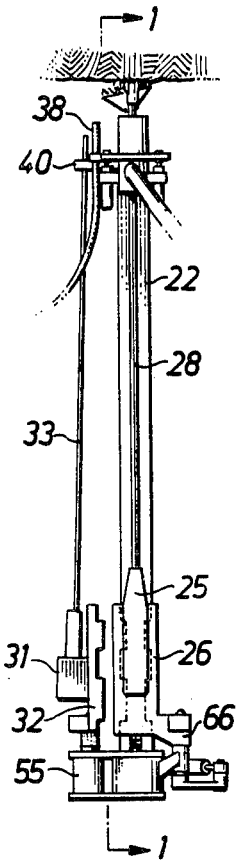
FIG. 2 is a view seen as indicated by arrows 2—2 in FIG. 1.
Figure 3:
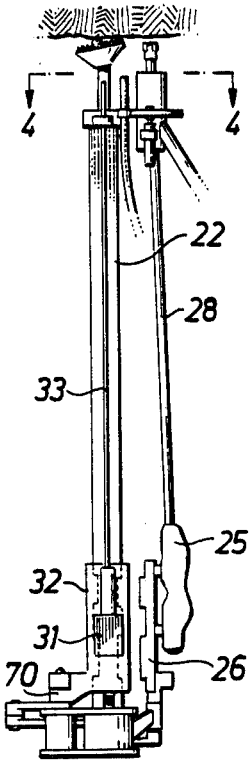
FIG. 3 is a view corresponding to FIG. 2 but showing alternative positions of various elements.

The feed beam 22 has a support 24 that is hydraulically extendible against the rock face. A percussion rock drill 25 is mounted on a slide or cradle 26 that is slidably mounted on the feed beam 22 as shown in FIG. 1. The rock drill 25 is coupled to a drill steel 28 that is guided by a drill steel centralizer 29 mounted on the front end of the feed beam 22. The drill steel centralizer 29 is combined with a suction hood for collecting dust and it is connected to a suction hose 41. The drill steel 28 has a drill bit 30. A feed motor has been designed 27. In order to make FIG. 1 more clear, a bolt setting device 31 has been cut away but it is shown in FIGS. 2 and 3. In FIG. 2, the rock drill 25 is shown in its working position with its cradle 26 sliding on the feed beam 22. The bolt setting device comprises a hydraulic motor 31 for rotating a rock bolt 33. The bolt setting device 31 is mounted on a slide or cradle 32 and in FIG. 2 the cradle 32 with the bolt setting device 31 and a bolt 33 has been swung away from its working position. In FIG. 3, the cradle 26 with the rock drill 25 has been swung away from its working position and the cradle 32 with the bolt setting device 31 has instead been swung into working position on the feed beam.

Figure 4:
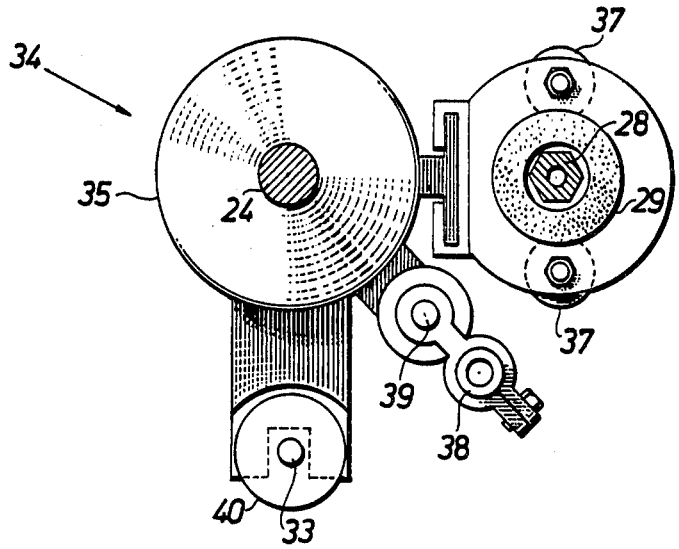
FIG. 4 is a section taken along line 4—4 in FIG. 3.
Figure 5:
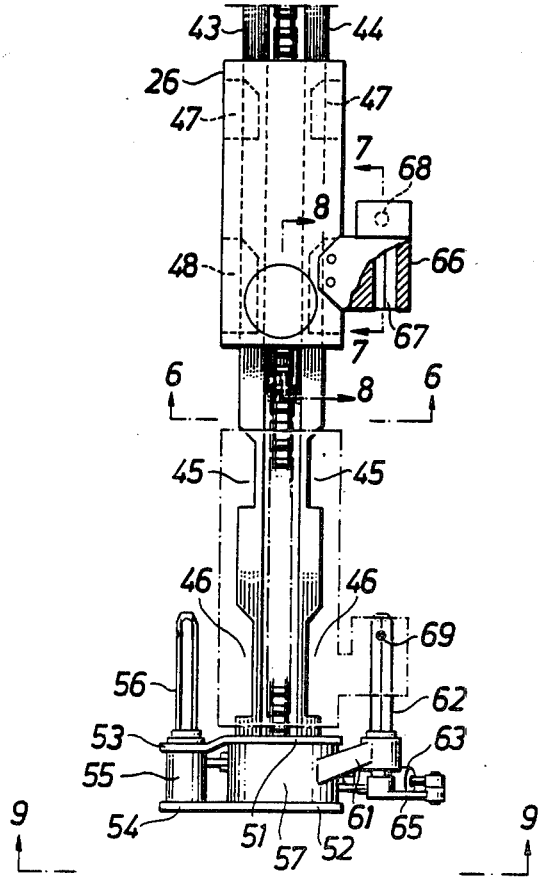
FIG. 5 is a fragmentary view, partly in section, corresponding to FIG. 2 but on a larger scale.

A unit 34 is turnably mounted on the front part of the feed beam 22 and it can be turned by means of a turn motor 35 that is built into the unit. The turn motor may be an annular hydraulic two-vane motor 35 of a well-known kind and it is not described nor shown in detail. The swingable unit 34 carries the drill steel centralizer 29 which is axially displacable by means of two hydraulic cylinders 37, a loading pipe 38 for resin cartridges, which is axially displacable by means of a hydraulic cylinder 39, and a bolt centralizer 40. The turn motor 35 is associated with a non-illustrated mechanical indexing device so that the unit 34 can take up three fixed angular positions at 45° angular distance; namely: the bolt centralizer 40 turned into its working position as shown in FIGS. 3 and 4, the drill steel centralizer 29 turned into its working position as shown in FIGS. 1 and 2, and an intermediate position in which the loading pipe 38 is turned into its working position in line with the bore hole. FIG. 5 is a view corresponding to FIG. 4 and it shows on a larger scale the rear end of the feed beam 22. In FIG. 5, the cradle 26 for the rock drill 25 is schematically shown with the rock drill removed whereas the bolt setting device 31 and its cradle 32 is not at all shown. The feed beam 22 has two flanges 43,44 that act as guides for the cradle 26. The rear end of these guides 43,44 has pairs of recesses 45,46. On each side, the cradle 26 has flanges 47,48 that slide against the underside of the guides 43,44 of the feed beam. These flanges 47,48 are shown in dotted lines in FIG. 5. The recesses 45,46 in the guides 43,44 of the feed beam permit the cradle 26 to be swung away when the cradle is in its rearmost position indicated with dotted contour lines since the flanges 47,48 of the cradle is then just opposite the recesses 45,46 of the guides 43,44.

Figure 6:
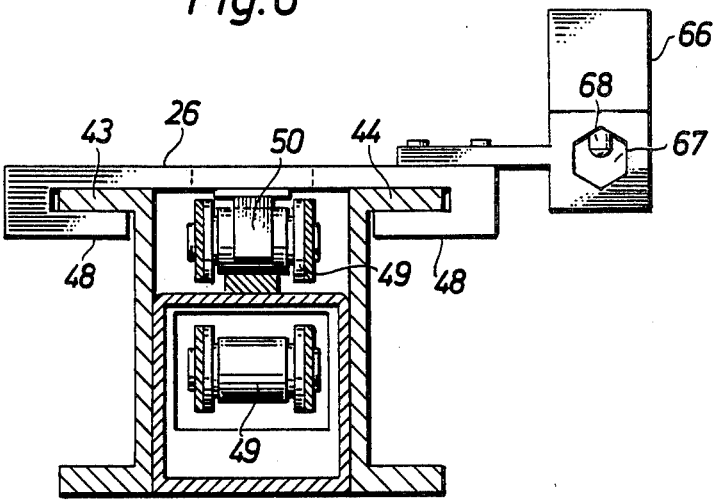
FIG. 6 is a cross section taken along line 6—6 in FIG. 5.
Figure 7:
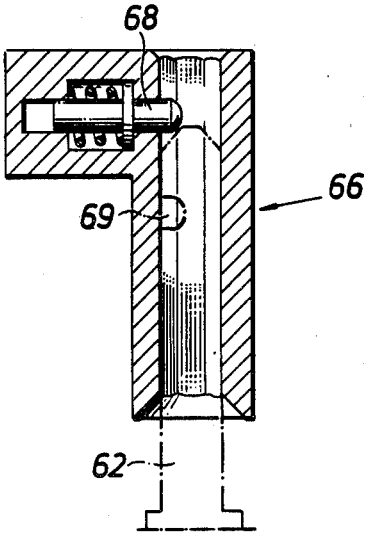
FIG. 7 is a section along line 7—7 in FIG. 5.
Figure 8:
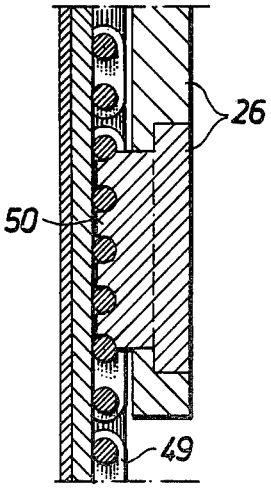
FIG. 8 is a section along line 8—8 in FIG. 5.

In FIG. 6, a feed chain 49 is shown that runs in a closed loop and is driven by the feed motor 27 that is shown in FIG. 1. The cradle 26 of the rock drill 25 is coupled to the feed chain 49 by means of spurs 50 that extend into the chain and can be seen in FIGS. 6 and 8.

The rear end of the feed beam 22 has two flanges 51,52 that have two arms 53,54 that carry an hydraulic turn motor 55. A hexagonal pin 56 is fixedly mounted on the output shaft of the turn motor 55 so as to form a forward directed extension of the output shaft. The turn motor 55 is able to turn the hexagonal pin 56 to an angle of 90°. A sleeve 57 is journalled between the flanges 51,52.

A radial arm 58 (FIG. 9) is mounted on the hexagonal pin 56 to follow the latter in its turning movement. A link 59 is pivotably coupled between the outer end of the arm 58 and a lug 60 on the sleeve 57. The sleeve 57 has an arm 61 that rotatably carries another hexagonal pin 62. This hexagonal pin 62 can be turned through an angle that is less than 45° by means of an hydraulic cylinder 63 that is pivotably coupled between a lug 64 on the sleeve 57 and a radial arm 65 fixed to the hexagonal pin 62.

The cradle 26 of the rock drill has a bracket 66 with a hexagonal hole 67. A spring-loaded lock bolt 69 extends transversely into this hole 67. When the cradle 26 is moved rearwardly to its rear end position by means of the feed motor 27 and the feed chain 49, the hexagonal pin 62 will extend into the hexagonal hole 67. Since the pin 62 has a conical end, it will push the lock bolt 68 outwardly and when the cradle 26 reaches its rearmost position the lock bolt 68 will snap into a recess 69 in the pin 62 and axially lock the cradle 26 to the pin 62. The lock bolt 68 will then positively hold the cradle 26 both axially and angularly when the cradle is uncoupled from the guides 43,44 also if the entire feed beam 22 is turned upside-down. The lock bolt 68 can be hydraulically withdrawn to permit the cradle 26 to be released from the pin 62.

The cradle 32 of the bolt setting device 31 is identical with the cradle 26 of the rock drill 25 but it has a bracket 70 that is the reflected image of the bracket 66 and that cooperates with the pin 56 in the same way as the bracket 66 cooperates with the pin 62. Since the cradles 26,32 and their brackets operate in the same way, the cradle 32 of the bolt setting device 31 is not shown in FIG. 5. When the cradle 26 of the rock drill 25 is in its working position slidable along the feed beam as shown in FIGS. 3 and 5, the cradle 32 of the bolt setting device 31 is in fact positively locked both axially and angularly on the pin 56 as shown in FIG. 2.

Figure 9:
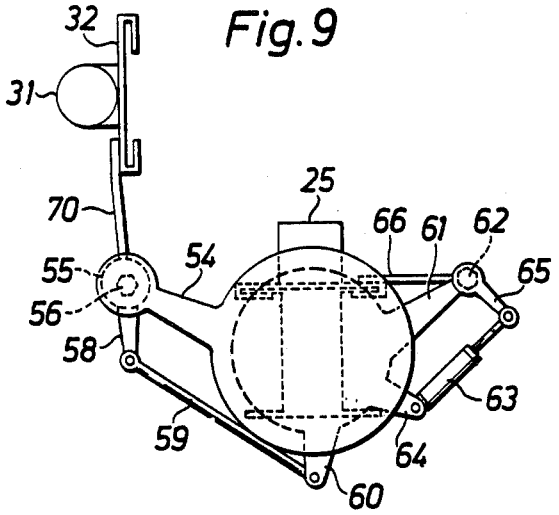
FIGS. 9–11 show very schematically various alternative positions of the rock drill and the bolt setting device on the feed beam, FIGS. 9–11 being seen as indicated by arrows 9—9 in FIG. 5
Figure 10:
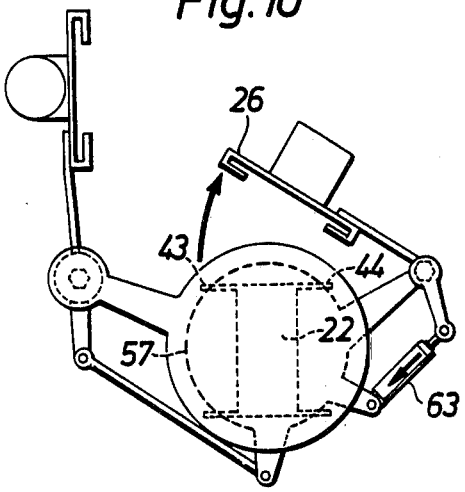
Figure 11:
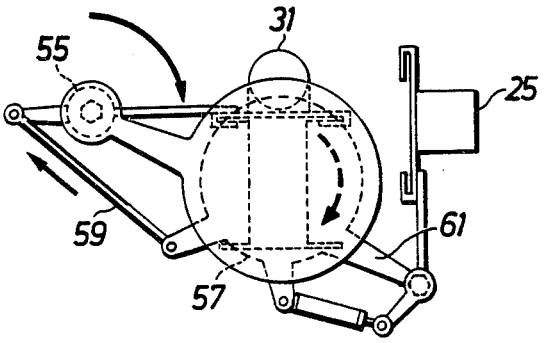

In FIGS. 9–11, there is shown very schematically how one cradle on the feed beam is exchanged for the other. FIG. 9 shows a position corresponding to FIG. 2 in which the rock drill 25 is in its working position, that is, its cradle 26 is in sliding engagement with the guides 43,44 of the feed beam 22, and the bolt setting device 31 is swung away from the guides. The rock drill 25 is now positioned to drill a hole in the rock face. When the bore hole has been completed, the rock drill is moved to its rearmost position on the feed beam. By means of the hydraulic cylinder 63, the pin 62 is then turned so that the cradle 26 and the rock drill 25 are swung up from the guides to their position shown in FIG. 10. Then the turn motor 55 is operated to turn the hexagonal pin 56 so that the cradle 32 and the bolt setting device 31 are swung into working position on the guides 43,44 as shown in FIG. 11. Due to the link 59, the sleeve 57 is simultaneously turned so that the hexagonal pin 62 carried by the arm 61 and the rock drill 25 is moved to the position shown in FIG. 11.

Most frequently, rock bolts without expanding units are used today, and before the bolt is inserted into the bore hole, the bore hole is loaded with cartridges of a hardening matrix, usually a two-component resin having sand as a filler. The resin is mixed by the bolt when the bolt is fed into the bore hole and simultaneously rotated, and the resin hardens as soon as it is mixed. Thus, after each drilling operation, the hole just drilled must be loaded. The turn motors 35,55 should suitably operate in synchronism and both should have an intermediate position in which the loading pipe 38 is in line with the bore hole just drilled. The loading pipe 38 is moved against the mouth of the bore hole by means of the hydraulic cylinder 39 and the cartridges can be blown into the bore hole through the pipe 38 and the hose connected to it.

The support 24 comprises of a piston rod of a hydraulic cylinder that is mounted in the feed beam 22 and the piston area for extending this piston rod 24 is smaller than the piston area for extending the piston rod 23 that is used for extending the feed beam 22 in its holder 19. As a result the support 24 can be hydraulically biased outwardly against the rock face during the entire operation and the feed beam displacing cylinder 23 can be used to move the feed beam axially between the working position of the feed beam in FIG. 1 and the somewhat retracted position of the feed beam for allowing shifting of cradles shown in FIGS. 2 and 3 with the support (24) maintaining a constant force against the rock. By this arrangement with both a support 24 extendible forwardly and an axially movable feed beam 22, drilling can always start from the position shown in FIG. 1 with the bit 30 in contact with the rock face and the rock drill 25 in its rearmost position on the feed beam. As a result, all bore holes will have exactly the same length, a length that is pre-determined to fit the length of the rock bolts.

I claim:

1. Rock bolting apparatus comprising:

a rock drill (25);

a bolt setting device (31);

a feed beam (22) on which said rock drill (25) and bolt setting device (31) are mounted, the feed beam having elongated guide means (43,44) and a feeding device (27,49) which is common to said rock drill (25) and to said bolt setting device (31);

said rock drill and said bolt setting device both being mounted on the feed beam to be alternatively movable into and out of a working position on said guide means; and power means (55,56,62,63) for alternately moving said rock drill and said bolt setting device into and out of a working position on said guide means.

2. Rock bolting apparatus according to claim 1 wherein the rock drill (25) and the bolt setting device (31) are provided with means (50) for automatically coupling them to said feeding device (27,49) when they are displaced into working position on the guide means.

3. Rock bolting apparatus according to claim 1 wherein said power means (55,56,62,63) for displacing the rock drill (25) and the bolt setting device (31) respectively to and from working position on the guide means include means for coupling same to the rock drill (25) and to the bolt setting device (31) respectively when the respective one of the rock drill and the bolt setting device that is in its working position reaches a rear position on the guide means (43,44).

4. Rock bolting apparatus according to claim 3 wherein the rock drill (25) and the bolt setting device (31) are releasable from the guide means (43,44) in said rear position.

5. Rock bolting apparatus according to claim 1 wherein the rock drill (25) and the bolt setting device (31) are selectively coupled to said power means and positively locked to the guide means in all positions in which they are uncoupled from said power means.

6. Rock bolting apparatus according to claim 1 wherein the rock drill (25) and the bolt setting device (31) are swingable to and from their working position about axes that are substantially parallel with the axis of drilling.

7. Rock bolting apparatus according to claim 6 further comprising respective docking elements (66,70) on the rock drill (25) and on the bolt setting device (31); and two docking elements (56,62) on the rear end of the feed beam (22) one of which is located at one side of the guide means (43,44) and arranged to cooperate with the docking element (66) on the rock drill (25) and the other of which is located on the other side of the guide means and arranged to cooperate with the docking element (70) on the bolt setting device (31), the two docking elements (56,62) on said feed beam being turnably mounted on the feed beam (22), and power means for turning the two docking elements (56,62) of the feed beam so as to swing the rock drill (25) and the bolt setting device (31) respectively into and out of working position.

8. Rock bolting apparatus according to claim 6 wherein the rock drill 25 and the bolt setting device (31) are mounted on cradles (26,32) that have guide elements (47,48) cooperating with said guide means (43,44) of said feed beam, said guide means (43,44) of said feed beam having recesses (45,46) to permit said guide elements (47,48) of the cradles to pass the guide means of said feed beam when the cradles (26,32) are moved to and from working position when the cradles are in rear positions.

9. Rock bolting apparatus according to claim 8 wherein the cradles (26,32) are provided with means (50) arranged to be coupled to the feeding device (27,49) when the cradles are swung into working position.

10. Rock bolting apparatus according to claim 8 wherein the feeding device comprises a feed chain (49) that is driven by a motor (27), and the cradles (26,32) are provided with means (50) that engages with the feed chain (49) to lock the cradles to the feed chain when the cradles are swung to their working position.

11. Rock bolting apparatus according to claim 7 wherein said docking elements on the feed beam (22) comprise two forward directed pins (56,62) with non-circular cross-sections.

12. Rock bolting apparatus according to claim 11 further comprising locking means (68) to axially lock cooperating pairs of said docking elements (62,66 and 56,70 respectively) to each other.

13. Rock bolting apparatus according to claim 12 wherein said locking means (68) are snap locking means to automatically lock cooperating pairs of docking elements (62,66 and 56,70 respectively) to each other when the respective cradle (26,32) reaches its rear end position.

14. Rock bolting apparatus according to claim 4 wherein said rear positions are end positions of the rock drill (25) and bolt setting device (31) on the feed beam (22).

15. Rock bolting apparatus according to claim 1 further comprising a holder (19) carrying the feed beam (22), the feed beam being axially displacable in said holder, power means for moving the feed beam axially in said holder, and a support (24) mounted on the front end of the feed beam and power extendable forwardly in the direction of the feed beam to take support against a rock face.

16. Rock bolting apparatus according to claim 15 wherein said power means for axially displacing the feed beam (22) in its holder (19) comprises a hydraulic jack (23) that is parallel with the feed beam, and said support (24) comprises a hydraulic jack (24) that is parallel with the feed beam (22).

17. Rock bolting apparatus according to claim 1 further comprising a drill steel centralizer (29) and a rock bolt centralizer (40) both of which are mounted on the front end of the feed beam (22), said centralizers being alternatively swingable into alignment with the axis of drilling.

18. Rock bolting apparatus according to claim 17 comprising a unit (34) mounted on the feed beam and being turnable about an axis parallel with the feed beam, and wherein the drill steel centralizer (29) and the rock bolt centralizer (40) are mounted on said unit (34), and power means (35) being provided for turning said unit (34) about said axis.

19. Rock bolting apparatus according to claim 18 wherein said turnable unit (34) further includes a loading pipe (38) and the turnable unit (34) is turnable into a position in which the loading pipe is aligned with the axis of drilling.

* * * * *